United States Patent [19]

Lecomte

[11] 3,978,679

[45] Sept. 7, 1976

[54] METHOD AND APPARATUS FOR UNDERWATER TRENCH EXCAVATION AND PIPELINE LAYING

[76] Inventor: Claude F. Lecomte, Prairie au Duc, 44040 Nates, France

[22] Filed: Jan. 22, 1975

[21] Appl. No.: 543,105

[30] Foreign Application Priority Data

Jan. 22, 1974 France ..... 74.02077

[52] U.S. Cl. ..... 61/72.4; 37/58; 37/63

[51] Int. Cl.[2] ..... E02F 5/06; F16L 1/00

[58] Field of Search ..... 61/72.4, 72.1; 37/58, 37/61, 62, 63, 65, 66, 67

[56] References Cited

UNITED STATES PATENTS

| | | | |
|---|---|---|---|
| 3,103,790 | 9/1963 | Popich | 61/72.4 |
| 3,429,131 | 2/1969 | Martin | 61/72.4 |
| 3,462,963 | 8/1969 | Moore | 61/72.4 |
| 3,590,589 | 7/1971 | Smulders | 61/72.4 |
| 3,857,250 | 12/1974 | Tella | 61/72.4 |

*Primary Examiner*—Jacob Shapiro
*Attorney, Agent, or Firm*—Sughrue, Rothwell, Mion, Zinn and Macpeak

[57] ABSTRACT

In the excavation of a trench on the seabed for receiving a pipeline, the pipeline is first laid on the seabed and subsequently the trench is excavated by an excavation machine which moves along side the pipeline and digs out material from beneath the pipeline. The machine contacts the pipeline to provide a control on the position of the machine relative to the pipeline and is self motivated.

23 Claims, 9 Drawing Figures

V

METHOD AND APPARATUS FOR UNDERWATER TRENCH EXCAVATION AND PIPELINE LAYING

This invention relates to a method of and apparatus for underwater trench excavation for distribution systems such as pipes.

The entrenchment of underwater pipelines is essential, particularly when the sea bed areas concerned are affected by considerable currents and also to guard against damage by anchors or trawlers, such damage leading possibly to the pipeline being placed temporarily out of commission and to pollution of the surrounding area.

Generally speaking the entrenching operation does not present any special difficulty in deep water when the sea bed is homogeneous and reasonably soft. Thus many methods have been considered in which a trench is first dug before the pipeline is submerged or in which the pipeline is submerged and placed in position at the same time as the excavation is carried out.

The main disadvantage of the former methods is the tendency for the trench to fill in naturally once it has been dug and before the pipeline has been laid. As far as the latter methods are concerned, they have the disadvantage that the speed of excavation of the trench is governed by the speed with which the pipeline can be laid.

As far as the machinery in current use is concerned, it has been designed with an apparent weight which is sufficiently low that the escort ship can pull it along easily, such machinery being mounted on runners. Advantage has been taken of this low weight construction to allow the machine to roll along the pipeline itself. The trench is then dug by dredging type disintegrators or by jet type disintegrators, the power sources required being located on the escort ship.

Despite the advantages of such machines, it is noted that they become unstable as soon as the sea bed becomes relatively hard. This is the case particularly when the machine is fitted with a blade type disintegrator for trench cutting. As the jet type disintegrators are not effective on a hard sea bed, it can be seen that use of a conventional machine on a hard sea bed presents a very definite and dangerous risk of being thrown off balance, particularly when moving over an uneven surface.

Furthermore, as soon as excavation is undertaken in any depth other than shallow water, the angle of drag becomes too great to allow the machine to be towed directly from the escort ship. To overcome this problem machines have been devised where use is made of a special anchor or deadweight for traction purposes. Because of this, such systems involve handling difficulties and extra work each time the deadweight has to be moved, resulting in loss of time. Added to these, disadvantages are difficulties resulting from the amount of space the system takes up and the ever-present risk of damage to the pipeline, particularly in the case where the machine rolls along it.

According to this invention there is provided a method of underwater excavation for entrenchment of a pipeline including laying a pipeline to be extrenched on the sea bed and subsequently digging the trench for the pipeline characterized in that the trench is dug by lateral excavation of the seabed immediately beneath the pipeline using a tractory excavation machine laterally contacting the pipeline.

Use of this method can enable the various disadvantages described above to be avoided. One is no longer dependent on the speed of the escorting ship's forward progress in order to follow a given direction and to have a given pull maintained in that direction and one is no longer obliged to use a deadweight or special anchor in order to dig the trench. The advantage resulting from knowledge of the firmness of the seabed surface after the pipeline has been lowered onto it and the maintainance of the tractory machine on the side of the pipeline ensures maximum protection against the permanent risk present in prior methods.

The trench may be dug first by distintegrating and removing the material lying underneath the pipeline by means of a disintegrating tool and then by finishing off the digging immediately adjacent to the pipeline by means of sea water jets.

In this way one is sure of obtaining the complete removal of material immediately below the pipeline, irrespective of the type of disintegrator tool used, the effectiveness of the jets being increased on account of the prior breaking up of the sea bed material by the tool.

A machine for carrying out the method may be characterised in that, in addition to means of digging underneath the pipeline, it is fitted with lateral followers which rest on the pipeline, motors for driving the machine's tracks, hydraulic power units for operating the digging mechanism and an electric cable for supplying electrical power to the machine from an escort ship on the surface.

Contrary to earlier type machines in which every endeavour was made to make them as light as possible, particularly by the use of floats and multiple control links between the surface ship and the machine, the machines for carrying out the method of this invention can be fitted with electric motors required not only for driving the digging mechanism but also for the forward progress of the machine. The resultant increase in weight is not compensated for in full thus enabling the machine to adopt a more stable position and to better resist any possible cross forces due to sea currents. In this way the machine has very great stability even on a very uneven seabed.

The invention will be more fully understood from the following description of an embodiment thereof, given by way of example only, with reference to the accompanying drawings.

Figure 1:
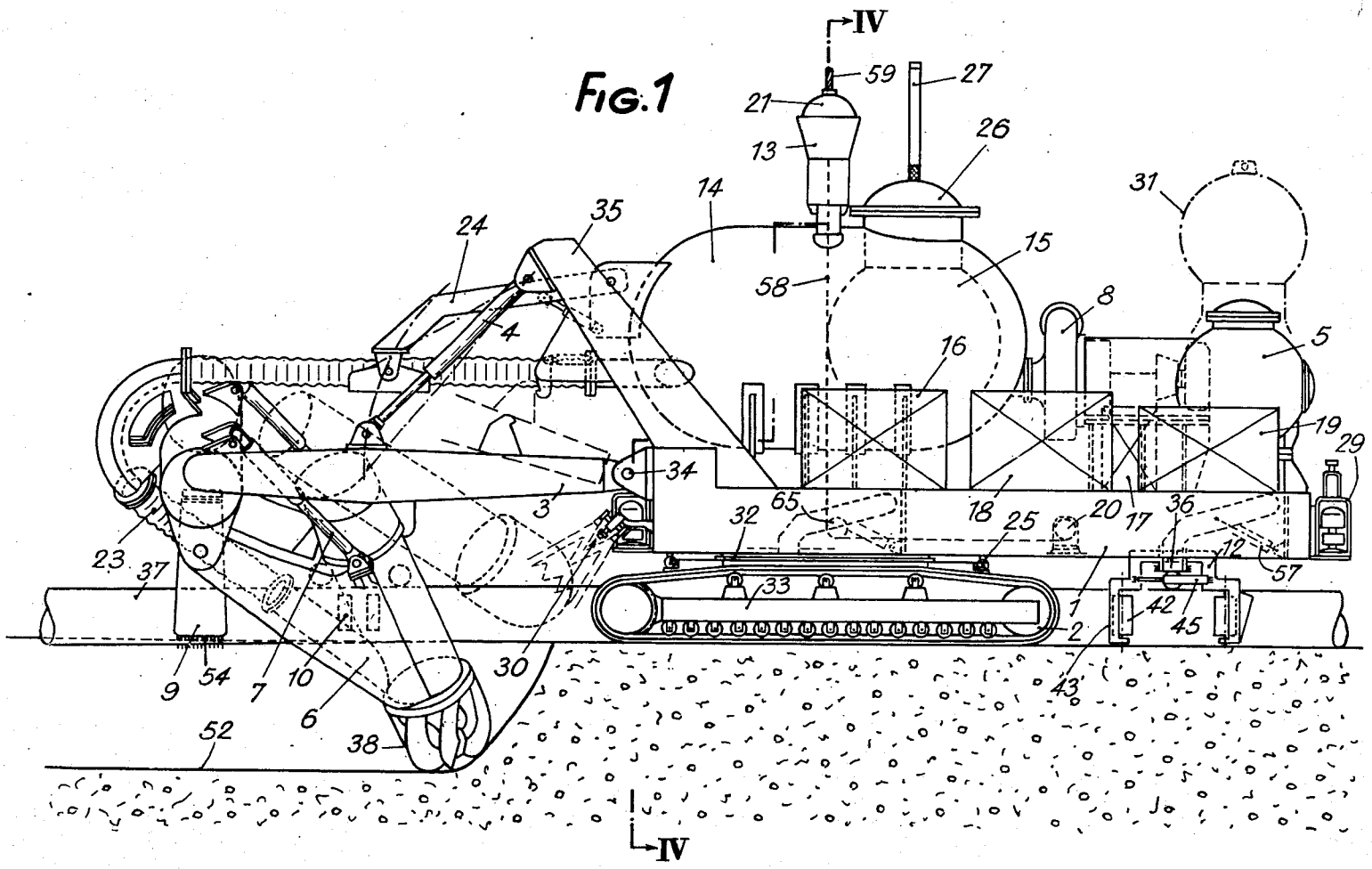
FIG. 1 is a diagrammatic view in elevation of an embodiment of a machine according to the invention.
Figure 2:
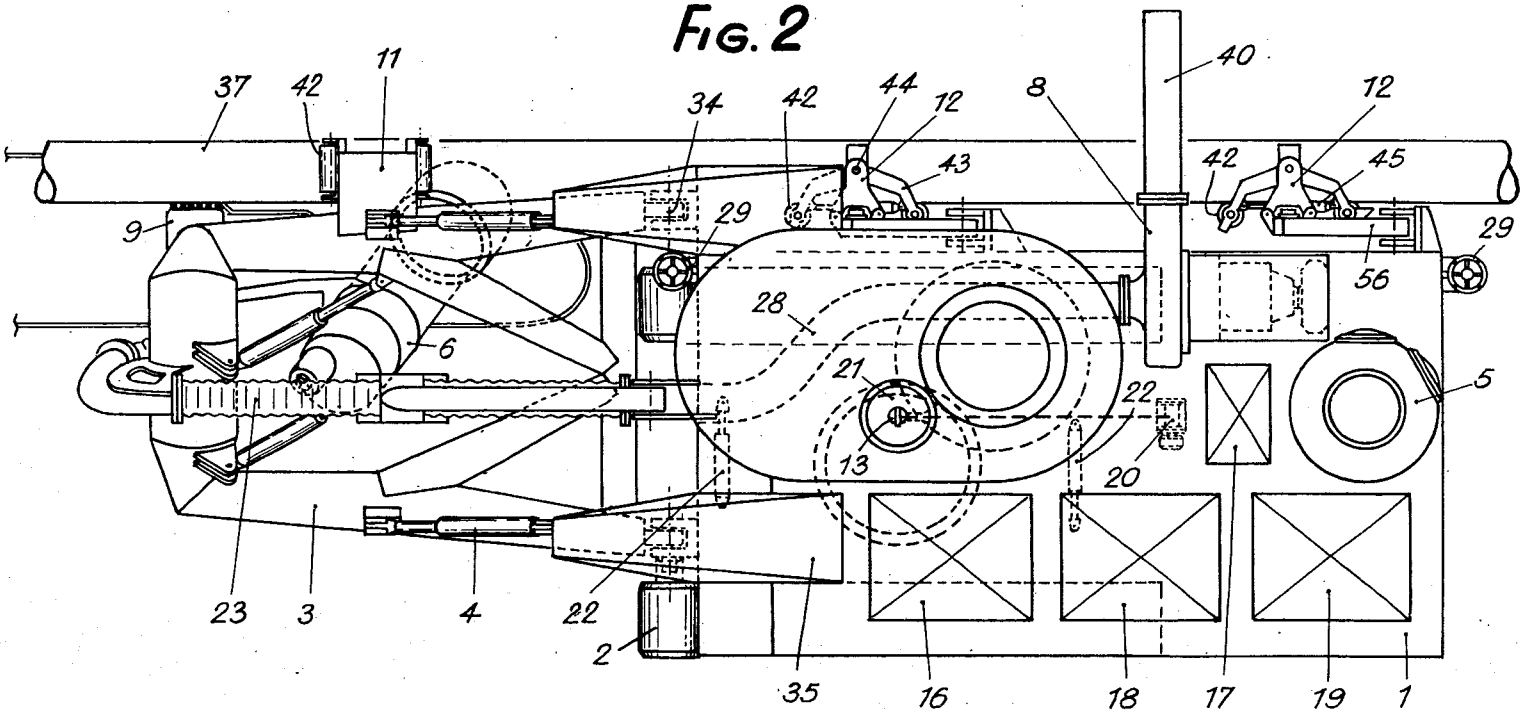
FIG. 2 is a plan view of the machine of FIG. 1.

An embodiment of a machine for trench excavation according to the invention is diagrammatically illustrated in FIGS. 1 to 4. This machine is used to dig a trench 52 underneath the distribution system pipeline 37 as shown, to be entrenched by digging laterally of the distribution system using a machine provided with a system of followers enabling the machine to remain close behind the distribution system.

The machine comprises a chassis 1, preferably made of high tensile steel, carried on a traversing ring 32 mounted on roller bearings 25, the traversing ring being carried by cross members 53 (FIG. 4) and two side members 33 which support tracks 2.

Fulcrum points 34 for dredging ladder 3 and two davits 35 for fixing lifting jacks 4 are fitted to the rear of chassis 1. On the pipeline side, the dredging ladder has an arm 11 (FIG. 5) which carries a follower device 10 provided with a balance 36 which indicates the load exerted on pipeline 37, and a device 44 which gives the angular movement between arms 43, each arm being fitted with a roller 42.

Dredging ladder 3 carries a dredging type disintegrator 6. The blades on the tool 38 are preferably provided with sets of cutting teeth which are interchangeable according to the type of seabed material encountered. These teeth have not been illustrated and may be of any known type. A group of hydraulic motors 16 drives the tool 38. The disintegrator 6 is pivotted at 39 on dredging ladder 3 and can perform a sweeping movement under the control of two jacks 7.

A suction sleeve 23 enables the spoil produced by the operation of tool 38 to be sucked up and removed by pump 8, which is operated by hydraulic group 18. The spoil is directed well clear of pipeline 37 by a conduit 40.

The tip 41 (FIG. 3) of material which forms an overhang directly beneath the pipeline 37, after disintegrator 6 has passed along, is collapsed by jets of sea water from detachable jets 54 fixed to assembly 9 and fed by a high pressure high delivery pump operated by hydraulic group 19. For example, the pump may have a delivery rate of 300 liters/minute at a pressure of 170 bars (70 gallons per minute at 2500 psi). Spoil produced by these jets is sucked up into the suction circuit of disintegrator 6.

Figures 3, 4, 5:
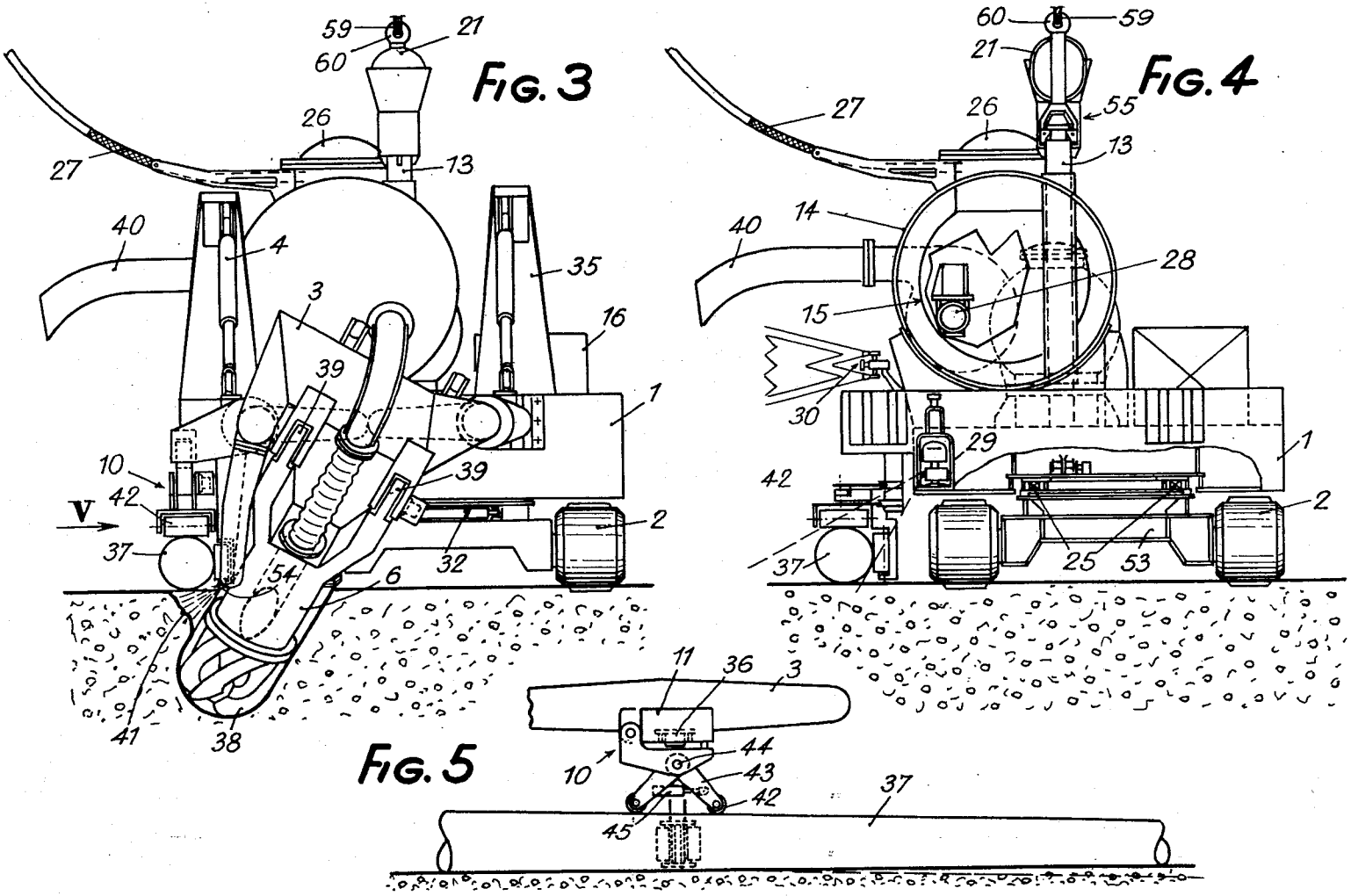
FIG. 3 is a rear view of the machine of FIG. 1.
FIG. 4 is a section along line IV—IV of FIG. 2.
FIG. 5 is the view of one of the machine's followers in elevation.

In order to ensure that there is continual lateral guidance of the machine by controlling the distance of the machine from pipeline 37, two followers 12 (FIGS. 1 and 2) are provided similarly to the follower 10 illustrated in FIG. 5, each having rollers 42 mounted on hinged arms 43 interconnected by a jack 45. Spindle 44 between the arms 43 operates a device for transmitting the value of the angle of separation of arms 43, this angle enabling the distance of the machine from pipeline 37 to be calculated for the point under consideration. Furthermore the load on jack 45 enables the pressure exerted by rollers 42 on the pipeline to be calculated by means of a balance 36 and depending on their distance apart. Once this information has been obtained by means of both followers 12, it is a straightforward matter, using both distance readings, to calculate the position of the front and rear of the machine in relation to pipeline 37, the average distance, the angle of the machine's direction in relation to the axis of pipeline 37 and the downward pressure applied. The operator, located in a releasable command sphere 5 is thus in a position to continually correct the path of the machine or, in the instance where a control shackle is fitted which ensures automatic correction of direction, just to check that the machine is operating correctly.

The device 10, illustrated in FIG. 5, is located between dredging ladder 3 and pipeline 37 to control the angular position of the dredging ladder 3 in relation to the pipeline. It will be appreciated that any angular variation of dredging ladder 3 leads to a variation in the depth of a trench for a given angle of attack of the toolholer. This information, then, is used to adjust the final depth of the trench for a given sweep of the dredging ladder.

Cameras 30 enable the cutting tool 38 to be examined at work, and the removal of the spoil to be observed; as a result the operation of the suction pump 8 can be regulated to suit actual conditions. Screens in sphere 5, which have not been illustrated, allow the operator to follow the progress of the work.

Figure 8:
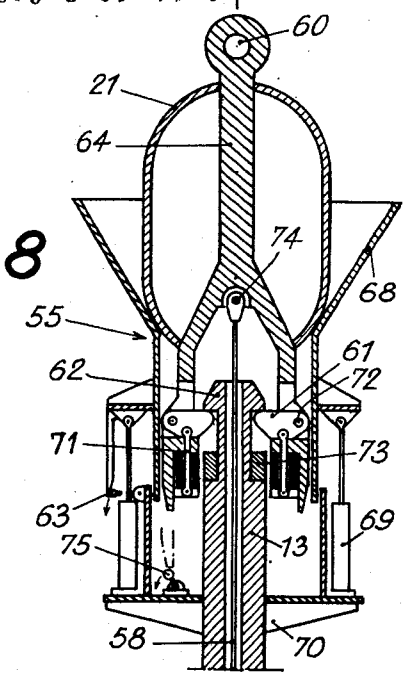
FIG. 8 is the diagrammatic view of a handling device in cross section.
Figure 9:
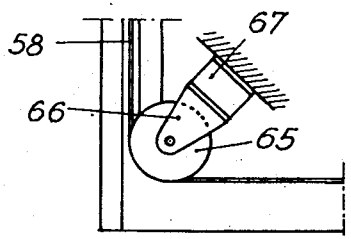
FIG. 9 is a detail of the control for the handling device.

In addition to the components which have just been described, it is obvious that the machine may be fitted with numerous additional devices. Thus a device may be provided at the front of the machine for observation purposes and for measuring various characteristics of the sea bed As shown, a connector assembly 55 (FIGS. 4 and 8) is provided enabling a jaw-holding device 64, fast with buoy 21, to be hooked onto a handling pillar 13. Jaw-holder 64 comprises a coupling 74 to hold a cable 58, driven by winch 20 (FIG. 1). Cable 58 passes inside pillar 13 and then round a pulley 65 (FIGS. 1 and 9) whose support bearing 66 is coupled with a tension detecting device 67. The connector assembly 55 comprises a funnel 68 designed to accept buoy 21 and is supported by a hydraulic suspension system 69 fast with fixed support 70. Assembly 55 is illustrated in FIG. 8 in a position in which jaws 61 of jaw-holder 64 are locked in position by tenon 62 forming part of pillar 13, the ends of jaws 61 adjacent the pillar 13 cannot tilt downwards any further because of their shape. These jaws, even though they are acted upon by return device 71 in the locked illustrated position, can, however, pivot around pins 72 when the jaw-holder 64 is moved down by tension in cable 58 induced by the actuation of winch 20. During the downward movement the jaws 61 contact sleeve 73 and pivot around their pins 72 compressing their return devices 71 in the process. Thus the jaws, in tilted position, at the end of the downward travel rest firmly against sleeve 73 which is a sliding fit in the annular recess in pillar 13, located immediately below tenon 62. To disengage jaw-holder 64 from pillar 13 it is necessary only to cease exerting a pull on cable 58 and to allow it to unwind from winch 20 under the effect of the load exerted by the buoy 21 of the jaw-holder 64 to allow the jaw-holder 64 to rise upwards taking sleeve 73 with it until the sleeve 73 abuts against tenon 62. At this point the jaws 61 become disengaged from tenon 62. Contacts operated by end-of-stroke stops 75 to signal the tilting of jaws 61 against sleeve 73 when jaw-holder assembly 64 is in its lowest position and contacts operated by end-of-stroke stops 63 to signal that the jaws 61 are locked by tenon 62 when the assembly is in the position illustrated in FIG. 8, enable the various operations necessary for handling and locating the entrenching machine to be undertaken.

A lightening chamber 14 is provided which, although of less importance in this machine than similar devices fitted to prior machines, has dimensions sufficient for it to contain an area 15 set aside for the electrical apparatus. The motor control devices, drive systems, and the various other control devices will not be described as all such devices are of conventional design.

It will be noted that recentering jacks 22 (FIG. 2) have been provided enabling the dredging ladder 3 to be positioned precisely in relation to the pipeline and that the lightening chamber 14 and the dredging ladder 3 together with davits 35 with which ladder 3 is connected by jacks 4, are offset towards the pipeline in relation to the symmetrical longitudinal centerline of tracks 2.

The installation and operation of the machine which has just been described takes place after pipeline 37 has been lowered onto the sea bed. A crane is used to place the machine in the water then, after immersion and, as a result, reduction in its apparent weight, it is lowered by means of a standard winch fitted with an over-run device. For this purpose a cable 59 is attached to eye 60 of jawholder 64, whose jaws are in the locked position as illustrated in FIG. 8. At the same time as the cable 59, connected to pillar 13 by connector 55, unwinds, the electrical services cable 27 is also unwound. The descent takes place at a certain distance away from pipeline 37. Once the machine is stationary on the sea bed the operators go down to command sphere 5 by means of a transfer bell 31.

If no automatic device is provided on the machine to disconnect cable 59 from eye 60, the cable 59 may be disconnected from the surface by any known remote control means, for example, by using cable 27 to control by electrical means a hydraulic distributor which operates winch 20. Funnel 68 and jaw holding device 64 is acted upon in the downward direction by buoy 21, pulled by cable 58, until the end-of-travel locking contact 75 is operated by the action of the lower end of a return device 71 after jaws 61 have been tilted up against sleeve 73. This contact controls the unwinding of cable 58 and, as a result, the rising to the surface of buoy 21 and its jaw-holder 64, with cable 59.

When the machine is on the sea bed with cable 59 disconnected from eye 60 and reconnection of the cable is desired, it is only necessary to proceed in a manner identical to that which has just been described, assuming that the buoy starts in a position illustrated in FIG. 8. When the buoy reaches the surface, the tension detecting device 67, FIG. 9, transmits a control signal following the drop in tension in cable 58 resulting from the buoy ceasing to ascend at the instant it floats on the surface. This signal is transmitted by any conventional means to winch 20 causing it to stop. Once cable 59 is connected to eye 60, winch 20 is again remotely controlled from the surface to draw the buoy 21 downwardly until it again enters funnel 68 whereat jaws 61 tilt against tenon 62 on pillar 13. Wince 20 stops as soon as the inner ends of jaws 61 have passed below tenon 62 when the lower end of funnel assembly 68 meets the end-of-stroke locking stop 63, whose contact transmits a stop signal to winch 20. The jaws take up the position illustrated in FIG. 8 due to the effect of the buoy. Thus cable 59 is reconnected to the machine by pillar 13 and connector 55 and the machine can once again be brought up to the surface.

The machine may be used after disconnecting carrying cable 59 from eye 60, either by leaving buoy 21 free to float on the surface to indicate the whereabouts of the machine or by returning the buoy 21 into its location in funnel 68.

Once the machine is on the sea bed, the operators manoeuvre the machine to aligning it up on the edge of pipeline 37, using sonar devices 29, one such device being placed at the front and the other at the rear of the machine. Followers 12 are made to make contact with pipeline 37 for the purpose of controlling the parallelism of the machine and the pipeline during operation of the machine. Each follower 12 is supported by a lifting arm 56 (FIG. 2) controlled by a jack 57 (FIG. 1). The machine is reversed until the starting point for entrenching is reached. When the dredging ladder 3 has been lowered and a check made of its distance from pipeline 37, the trench is dug both by longitudinal step-by-step displacement of the machine, the dredging ladder being adjusted to a constant angle of attack thus making blades 38 on disintegrator 6 penetrate the sea bed below pipeline 37, and by a circular dredging movement of the disintegrator about pivots 39. At the same time, the tip 41 of material is broken up by the jets 54 on assembly 9, the spoil is sucked up continually by pump 8. Pipeline 37 will thus descend slowly into the excavated trench.

When digging operations have to be interrupted and the machine brought back to the surface, the location where work was halted can be marked by a sonar panel to enable it to be found later on by the screen. The machine is moved away from the pipeline and the operators are brought up to the surface. If the cable 59 has been disconnected from the surface, it can be seen that only this connection need be remade and the buoy re-entered into its location in funnel 68 for the cable to become automatically connected to handling pillar 13 by means of connector 55. The machine can then be raised to the surface.

Figure 6:
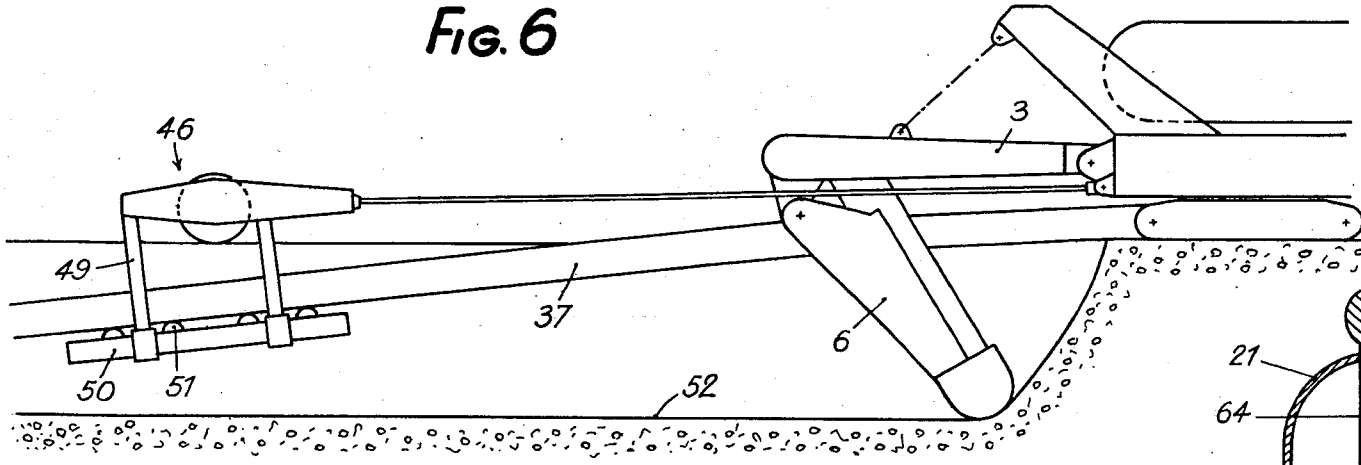
FIG. 6 is the diagrammatic view of a pipeline supporting trolley in elevation.
Figure 7:
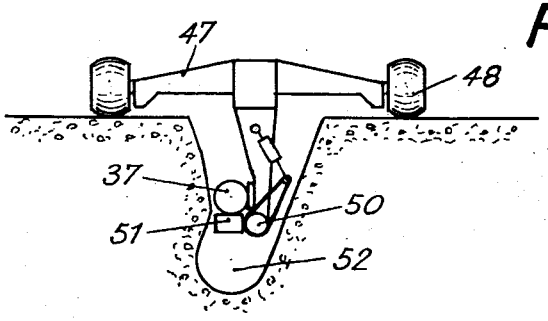
FIG. 7 is the view of the trolley from the rear.

If the pipeline needs to be placed in a relatively deep trench, for example one of about 4 meters (13 ft.) in depth, then too great a strain on the pipeline can be avoided by placing a supporting trolley 46 (FIGS. 6 and 7) a suitable distance away, say 30 meters (97 ft.), from the rear of the machine. As shown, the supporting trolley comprises a cross member 47 running on wheels 48, and arms 49 supporting an assembly 50 provided with bearing rollers 51.

In the event of work being interrupted, supporting trolley 46 may be left behind by disconnecting it automatically from the machine, recoupling up of the trolley to the machine being carried out by remote control using cameras 30 and directed from command sphere 5.

The various remote control installations provided in the machine, for example for the transmission of pictures by cameras 30, information from sonar devices 29, and measurements of distances of the machine from pipeline 37 provided by measurement of the angles between follower arms 43, automatic or manual control of jacks 22, 4 and 7 for example, and the control of the driving tracks 2, will not be described because they are conventional.

It will be understood that the machine may include a second tool **6*a* on disintegrator 6 which works laterally in the same way to dig underneath pipeline 37. The second tool can preferably be mounted on dredging ladder 3, a single device 10 ensuring control of the distance of the tools from the pipeline. Thus the second tool could be very much lighter in weight than the main disintegrator 6** and it could be offset in relation to the latter with the object of dispensing with the jet type disintegrator.

I claim:

1. In a method of underwater excavation for entrenchment of a pipeline including laying a pipeline to be entrenched on the sea bed and subsequently digging the trench for the pipeline wherein the improvement comprises the steps of: digging the trench by a single lateral excavation of the seabed immediately beneath the pipeline using a tractory excavation machine, said machine positioned laterally from and contacting the pipeline and said trench is excavated on the same lateral side of the pipeline as said machine is positioned.

2. A method according to claim 1 characterized in that the trench is dug laterally beneath the pipeline by means of a dredging type disintegrator of the machine and with circular action operating immediately below the pipeline.

3. A method according to claim 2 characterized in that the lateral excavation beneath the pipeline is carried out step by step, the disintegrator including a tool which is driven in circular motion to penetrate the seabed at a given angle of attack by forward motion of the tractory machine, the forward movement being followed by a circular dredging movement of the disintegrator.

4. A method according to claim 2 characterized in that digging of the trench is completed by the action of high pressure jets aimed at the material overhanging the cavity formed by the disintegrator and which is left immediately beneath the pipe line after the disintegrator has completed its circular action.

5. A method according to claim 1 characterized in that the machine is continually maintained adjacent the pipeline by controlling the distance of the machine from the pipeline at two points and by readjusting the average distance by controlling tracks on the tractory machine.

6. A method according to claim 1 characterized in that the depth of the trench is controlled by measurements of pressure and distance supplied by a follower coupled to the excavation tool of the machine and resting on the pipeline.

7. A method according to claim 1 characterized in that the rate of lowering of the pipeline into the trench is controlled by limiting its descent to a given depth at a predetermined distance from the point of excavation.

8. A method according to claim 1 characterized in that before excavation commences the machine is lowered to the seabed some distance from the pipeline, the approach towards the pipeline being controlled by sonar devices and then by lateral followers providing information as to the distance of the machine from the pipeline at two points.

9. A method according to claim 1 characterized in that excavation is carried out by the machine at the rear of the machine in relation to its forward movement parallel to the pipeline.

10. A method according to claim 1 when excavation ceases the machine is raised to the surface by a carrying cable, characterized in that the connecting of the cable to the machine is initiated automatically by controlling from the surface the raising of a buoy connectable directly and automatically to the machine, the carrying cable is then connected to the buoy and the buoy is relowered until it is automatically connected to the machine.

11. A machine for underwater excavation for entrenchment of a pipeline laid on a seabed comprising: an excavating means including a rotatable disintegrator, control means for causing the disintegrator to perform a circular dredging movement about an axis inclined to the horizontal to thereby dig a single lateral excavation of the seabed immediately beneath the pipeline, means for controlling the lateral distance between the machine and a pipeline to be entrenched thereby positioning said machine laterally from said pipeline, tracks for moving the machine, and an electrical power unit to be supplied with current from an escort ship via a connecting cable utilized for engaging the machine.

12. A machine according to claim 11 including jet means for disintegrating that part of the seabed immediately beneath the pipeline which cannot be reached by the disintegrator.

13. A machine according to claim 11 wherein the disintegrator is fixed to a dredging ladder having a roller type follower for resting on the pipeline to control the penetration of the disintegrator into the seabed.

14. A machine according to claim 11 wherein the distance controlling means comprises, two followers each arranged to press laterally on the pipeline, each follower including two rollers, each roller carried on a pivotal arm respectively, the two arms being interconnected by a jack, indicating means for indicating the angular separation of the arms, and a balance for indicating the load applied by the rollers to the pipeline, each follower transmitting information to a command sphere on the machine.

15. A machine according to claim 11 including at least two sonar devices for use in approaching a pipeline and at least two cameras for monitoring the depth of the trench and removal of spoil therefrom.

16. A machine according to claim 11 further including a control and command sphere provided with at least one manhole providing access for operators by a transfer bell lowered from an escort ship, a lightening chamber arranged on the pipeline side of the machine, a handling pillar provided with a buoy, a cable and a connector.

17. A machine according to claim 11 including at least one jack and a traversing ring, said ring disposed between the chassis and cross members carrying tracks for change of position of the machine, the jack acting on the traversing ring for reorientating the disintegrator.

18. A machine according to claim 11 characterised further by a pipeline supporting trolley, said trolley having roller means for supporting the inclined section of said pipeline which is partly positioned in the trench.

19. A machine according to claim 11 characterised in that the disintegrator is pivotted on a dredging ladder, said dredging ladder being carried by jacks connected to supporting arms, the arms being offset towards the pipeline in relation to the symmetrical longitudinal centerline of the tracks.

20. A machine according to claim 11 characterized by a lightening chamber offset towards the pipeline in relation to the symmetrical longitudinal centerline of the tracks.

21. A machine according to claim 11 characterized in that the disintegrator is offset towards the pipeline in relation to the symmetrical longitudinal centerline of the tracks.

22. A machine according to claim 11 characterized by a buoy provided with a jaw-holder, a winch for operating a cable connected to the jaw-holder and a handling pillar having connection means for the jaw-holder, the connection means being provided with a tenon on which the jaw-holder is engaged and contacts for transmitting signals to control the locking and unlocking of the jaw-holder on the pillar solely by winch operation.

23. A machine according to claim 22 characterized in that the contacts comprise a jaw locking control contact on the tenon and an unlocking control contact, a hydraulic suspension device and two movable components, being provided one of the movable components accepting the buoy and resting on the said suspension, the other movable component being slidable on the pillar immediately below the tenon for freeing the jaws from the tenon.

* * * * *

UNITED STATES PATENT OFFICE

CERTIFICATE OF CORRECTION

Patent No. 3,978,679 Dated September 7, 1976

Inventor(s) Claude F. Lecomte

It is certified that error appears in the above-identified patent and that said Letters Patent are hereby corrected as shown below:

In the heading insert:

Assignees: Compagnie Francaise Des Petroles, Paris, France; Etudes Petrolieres Marines, Paris, France; Ateliers Et Chantiers De Bretagne, Nantes, France; Compagnie Maritime D'Expertises, Marseille, France (and) Compagnie Generale Pour Les Developpements Operationnels Des Richesses Sous-Marines (DORIS).

Signed and Sealed this

Eighth Day of February 1977

[SEAL]

*Attest:*

RUTH C. MASON
*Attesting Officer*

C. MARSHALL DANN
*Commissioner of Patents and Trademarks*